United States Patent [19]

Kranz et al.

[11] Patent Number: 4,498,471

[45] Date of Patent: Feb. 12, 1985

[54] FIRST AND SECOND STAGE REGULATOR SYSTEM FOR BREATHING GAS

[75] Inventors: Max L. Kranz, La Habra; Donald L. Gadberry, Huntington Beach, both of Calif.

[73] Assignee: U.S.D. Corp., Santa Ana, Calif.

[21] Appl. No.: 425,405

[22] Filed: Sep. 28, 1982

[51] Int. Cl.[3] ..... A62B 7/04

[52] U.S. Cl. ..... 128/204.26; 128/205.24; 128/205.23; 128/202.22; 137/494; 137/505.12; 137/557; 137/599; 251/149.2

[58] Field of Search ..... 137/505.12, 557, 494, 137/DIG. 2, 599; 251/149.2; 128/204.26, 201.27, 202.22, 204.27, 205.24, 202.27, 912, 205.23, 207.12

[56] References Cited

U.S. PATENT DOCUMENTS

| | | | |
|---|---|---|---|
| 2,676,612 | 4/1954 | Stevenson | 137/505.12 |
| 2,854,001 | 9/1958 | Humblet | 128/202.22 |
| 2,861,588 | 11/1958 | Cronk | 137/505.12 |
| 3,111,946 | 11/1963 | Galeazzi | 137/505.12 |
| 3,224,409 | 12/1965 | Fenger et al. | 128/202.22 |
| 3,308,815 | 3/1967 | Wilcox et al. | 128/202.27 |
| 3,329,158 | 7/1967 | Geiszler | 128/204.26 |
| 3,584,596 | 6/1971 | Westcott | 128/202.22 |
| 3,722,510 | 3/1973 | Parker | 137/DIG. 9 |
| 3,805,780 | 4/1974 | Cramer et al. | 128/202.22 |
| 4,289,295 | 9/1981 | Allread | 251/149.2 |

FOREIGN PATENT DOCUMENTS

| | | | |
|---|---|---|---|
| 1045200 | 11/1958 | Fed. Rep. of Germany | 137/505.12 |
| 1104829 | 4/1961 | Fed. Rep. of Germany | 128/204.26 |
| 582141 | 11/1946 | United Kingdom | 137/DIG. 9 |

*Primary Examiner*—Henry J. Recla

*Attorney, Agent, or Firm*—George F. Bethel; Patience K. Bethel

[57] ABSTRACT

A first and second stage breathing gas regulator having a first stage redundant piston assembly with a first piston encompassing a second piston. In the eventuality the first piston fails, the second piston provides regulated gas. A safety alarm is provided when a pre-established pressure drop occurs, signalling a decrease in breathing gas by opening to provide gas to drive an audio alarm. The second stage regulator has a balanced second stage that operates with a valve lever in operative relationship to a diaphragm. A hand wheel and cammed valve permit the bypass of breathing gas around the valve of the second stage regulator when required. The outlet of the second stage regulator is provided with a trap door cover to avoid dirt and debris being introduced to the second stage regulator when a hose is not connected thereto.

29 Claims, 14 Drawing Figures

10
12
14
16
18
20
22
24
26
28
30
32
34
40
42
50
52
54
56
58
60
62
64
66
68
70
72
74
82
400
416
422
430
432
500
502
504

FIG. 9
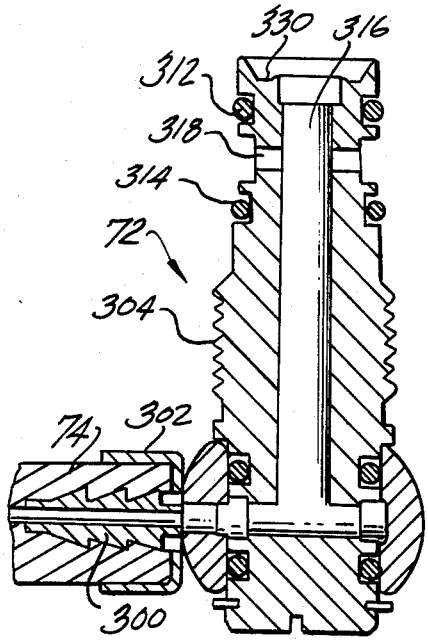
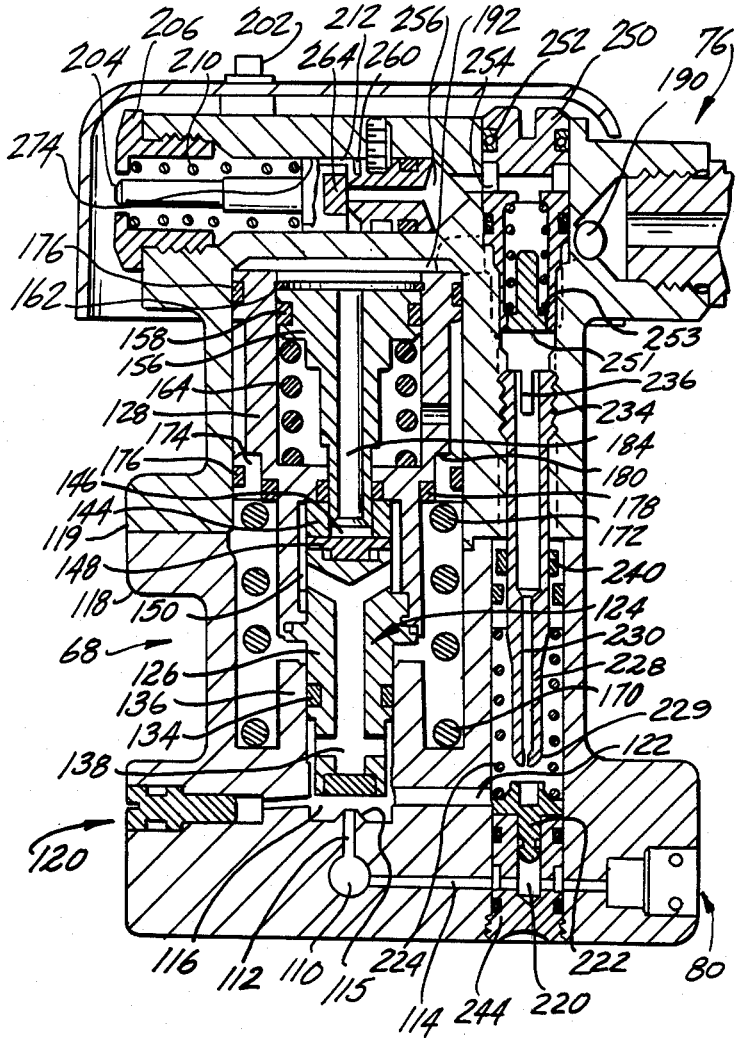
FIG. 7
FIG. 6
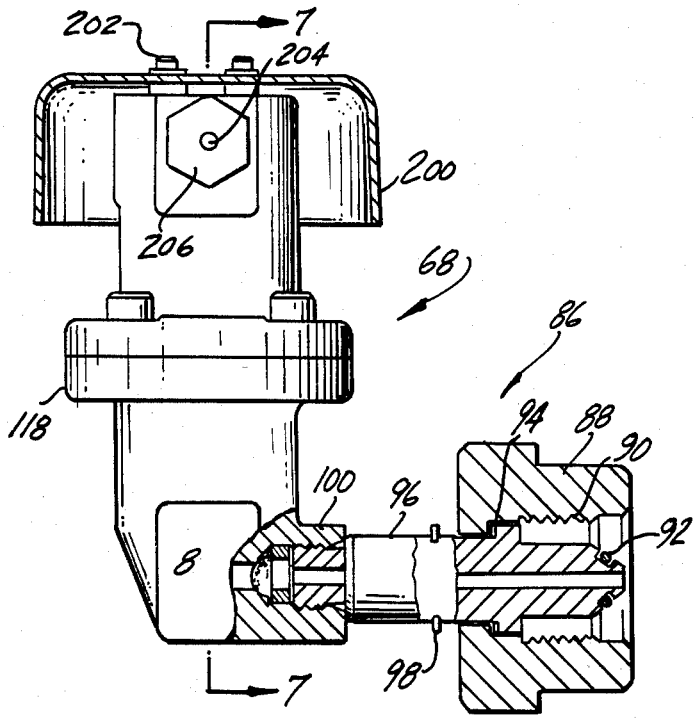
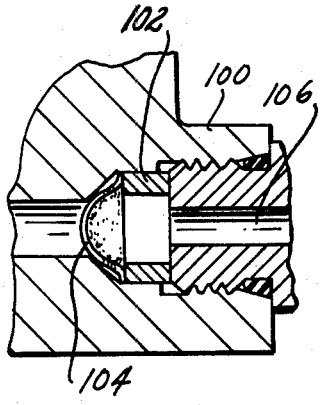
FIG. 8

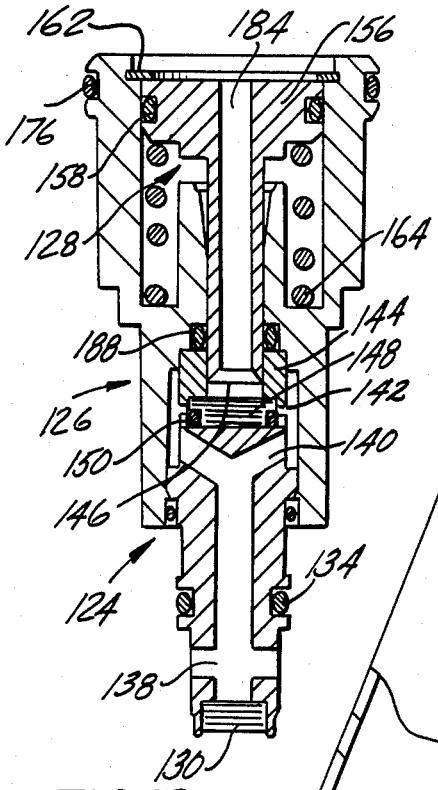
FIG.12
FIG.11
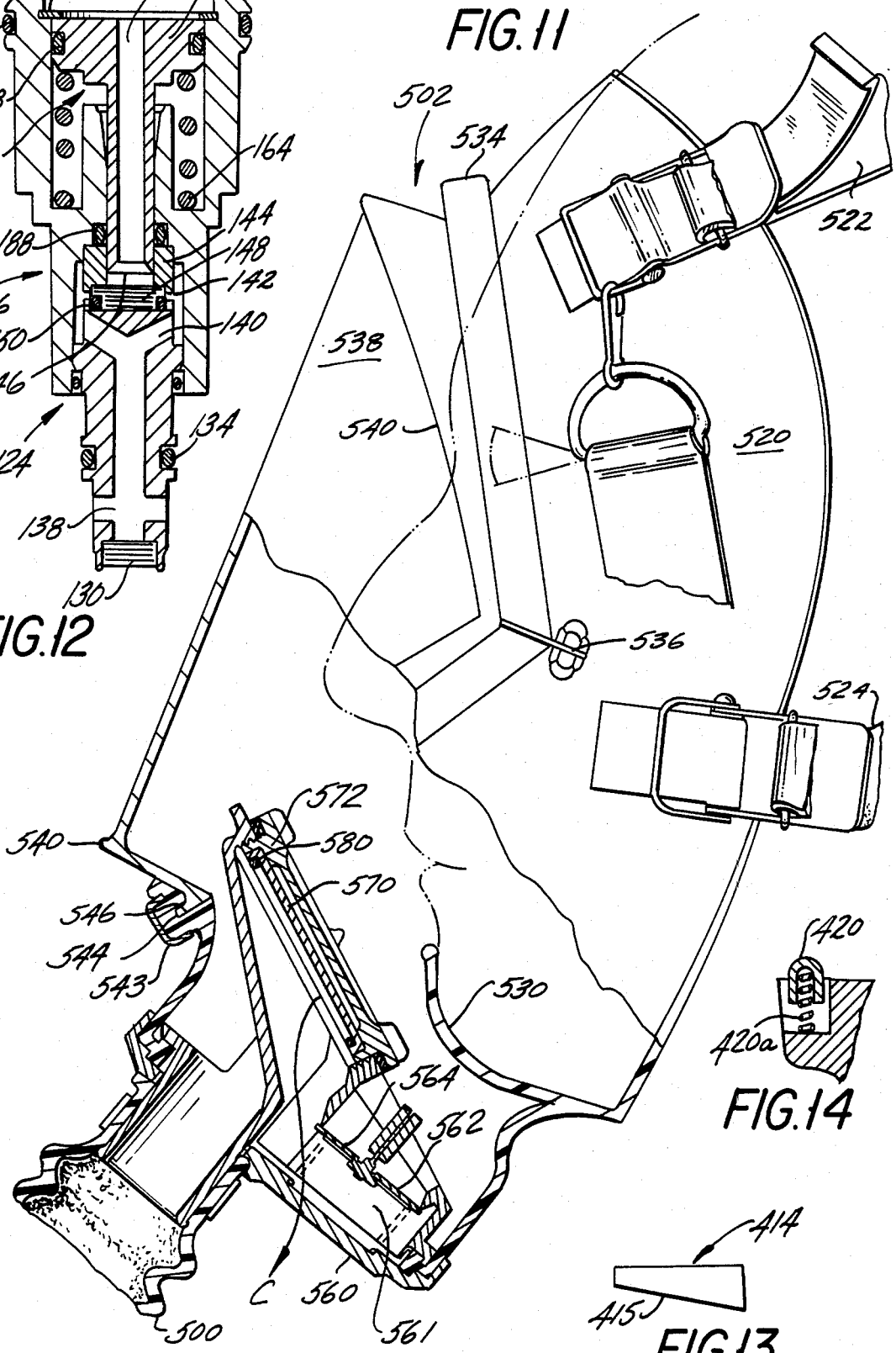
FIG.14
FIG.13

FIRST AND SECOND STAGE REGULATOR SYSTEM FOR BREATHING GAS

BACKGROUND OF THE INVENTION

1. Field of the Invention

The background of this invention lies within the art of regulating breathing gas. More particularly, it lies within the art of first and second stage regulators in combination with each other for regulating breathing gas, and in particular, can be used for industrial and firemens' usage.

2. The Prior Art

The prior art of first and second stage regulators has generally comprised various regulators having certain features and alarm functions. Such alarm functions have been provided by a ringing or rapping action upon the part of a knocker that knocks against a bell-like object. These particular first and second stage regulators also have bypass systems in order to allow for one to use the regulator when the gas pressure is low, or it fails.

In addition to the foregoing features of the prior art regulator systems, many of them have had certain features in order to provide for a user to know when his gas pressure is at a low level, such as gauges and audio warning devices. The prior art has also provided certain regulator systems with various conformations of attachment means for one's mask. However, in providing such attachment means, there has not been sufficient attention paid to the safety aspects in preventing deleterious substances and debris from entering into the operating elements of the regulator.

The prior art has not provided a dual range valving piston function to avoid the dangerous consequences of a first stage regulator failure. In particular, when a first stage regulator failed in the prior art, a user had to rely upon providing a direct flow in the form of a bypass which was extremely deleterious to the sensitivity of a second stage regulator and the components thereof. Such action could tend to damage a second stage regulator in a manner whereby it could not be used or function to provide the gas to a breather. Also, if a user were unconscious or incapacitated, he had no ability to provide gas upon first stage regulator failure.

This invention overcomes the deficiencies of the prior art by allowing a first stage main piston to maintain regulation over normal operation. When the first stage piston fails, or the regulator system fails in some other manner, a second piston within the first stage piston begins to operate. Upon operation, it specifically takes over the functions of the main first stage piston and provides regulation through the second piston for regulating the high pressure gas. Such regulation can extend over a period of time so as to not endanger a user.

It should be understood that most users of the type of regulator system disclosed herein and that of the prior art are industrial users in hazardous breathing gas surroundings or firemen in smoke or dangerous gas conditions. It is for this reason that an inherently overriding first stage redundant function is most important but has not been provided in the prior art. This invention allows for a fireman or an industrial user to maintain normal breathing functions through the first stage redundant interior regulator or second piston of this invention. The second piston automatically takes over the function of the main piston and provides continued first stage regulation. This protects the user and enhances the overall system of the invention hereof.

In addition to the foregoing features, this invention provides for an adjustable alarm system. The adjustable alarm system incorporates a poppet assembly and an adjustment seat for the poppet. The poppet assembly and adjustable seat are such that they sense low pressure for providing a flow of gas to an alarm system. The alarm system then rings, thereby allowing an audio report to be given to a user which warns him of the decrease in gas pressure.

The foregoing audio alarm system of this invention is specifically unique, inasmuch as it is adjustable as to both pressure and the rapidity of its ringing function. As can be appreciated, this is important in light of the prior art not having provided this flexibility. Furthermore, the alarm provides a warning of first stage regulator failure and incorporates a unique restrictor to enhance the operation of the alarm.

The second stage regulator of this invention incorporates an improved poppet valve assembly. The improved poppet valve assembly has a piston valve which opens and closes in response to diaphragmatic movement within the second stage regulator. When a user demands breathing gas, the diaphragm collapses, thereby causing a lever to operate the poppet valve piston. This causes the flow of gas from the first stage regulator to the second stage regulator and then to a user.

The second stage poppet valve piston is balanced across its face so as to allow for less effort with regard to diaphragmatic deformation through inhalation. In other words, when one inhales, the balanced second stage piston provides for a smoother operating function to avoid over-exertion upon the part of a user.

In addition to the foregoing advantages, the second stage regulator has a direct bypass which is such that it allows for breathing gas to be directly delivered to a user without turning a valve or operating a valving function. The user need merely turn a bypass ring or hand-wheel and a cam function releases a poppet valve to allow the bypass of gas directly to a user. This is important in emergency situations or regulator failure and enhances the overall safety of the second stage regulator.

The second stage regulator has an outlet port which has a cover which is actuated upon insertion of a hose that leads to a user's mask. The outlet port cover thereby prevents debris and other foreign substances from entering the second stage regulator.

The second stage regulator is connected by a hose to an improved mask which has a substantially improved seal, as well as a diaphragm for communication.

Accordingly, this invention is a substantial step over the prior art in providing the features of safety and overall operating efficiency not known in the prior art.

SUMMARY OF THE INVENTION

In summation, this invention comprises a new and novel first stage regulator having an improved alarm and redundant piston regulation combination of a main outer and inner regulator piston in combination with a second stage regulator that is balanced and has improved operating functions.

More particularly, the first stage regulator incorporates a main piston assembly that is utilized to regulate breathing gas on a first stage or high pressure basis. The main piston assembly has an interior piston or secondary piston therewith. The secondary piston assembly moves within the first stage piston. In the eventuality the first stage piston fails with respect to the passage and regulation of breathing gas, the second stage piston interiorly thereof takes over. Upon the second stage piston taking over, normal regulation continues through the first stage high pressure regulator.

Accordingly, when first stage regulation is taken over by the secondary or interior piston, a continuous flow of regulated gas takes place, thereby eliminating a failure of the first stage regulator.

The first stage regulator has a warning device in the form of an alarm. The alarm operates by means of a poppet assembly that senses low pressure. Upon sensing low pressure, it opens, thereby allowing a flow of gas to a ringing device. The ringing device comprises a spring driven plunger which is operated by the air that is vented thereto. As it rings, it apprises a user of the fact that gas has been sensed at a lower pressure, thereby warning the user of the time left to use the gas within the high pressure tank.

The first stage regulator has an outlet port connected to a second stage regulator. The second stage regulator incorporates a balanced poppet valve assembly. The balanced poppet valve assembly has equalized valve piston faces on either side to balance the entire valving function to prevent overexertion and undue cracking pressure required for opening the valve. The balanced valve is connected to a poppet valve lever which is in operative relationship with a diaphragm which senses decreases in pressure. Upon a decrease in pressure, the poppet valve piston operates to cause a flow of gas from the first stage regulator to be passed into the second stage regulator and thence to a user.

The second stage regulator has an outlet port which connects to a hose assembly which can connect to a mask or other breathing oral or oral-nasal cover. The outlet has a tilting cover which protects the interior of the second stage regulator and only opens upon insertion of the hose. Accordingly, debris and other extraneous material are kept from the second stage regulator to avoid operational failure thereof.

The second stage regulator is further enhanced by a hand-wheel bypass system which releases a poppet to allow direct flow through the second stage regulator. This avoids the requirement of turning valves or other devices in order to provide for direct flow to a user in the event of regulator failure.

The entire regulator system is enhanced in a singular and combination form, as will be seen in the following specification and claims, and is substantially improved over the prior art.

BRIEF DESCRIPTION OF THE DRAWINGS

The invention will be more clearly understood by reference to the description below taken in conjunction with the accompanying drawings wherein:

FIG. 6 shows a side elevation view of the first stage regulator as shown encircled by circle 6 of FIG. 1;

FIG. 7 shows a view of the first stage regulator as sectioned along line 7—7 of FIG. 6 detailing the internal portions thereof;

FIG. 8 shows the inlet port of the first stage regulator as seen through circle 8 of FIG. 6;

FIG. 9 shows a detailed view of the inlet connection of the second stage regulator as circled by circle 9 of FIG. 2;

FIG. 11 shows a side elevation view of the mask to be used with the regulator of this invention as sectioned partially through circle 11 of FIG. 1;

FIG. 12 shows a sectional view of the valve assembly of this invention as taken from the interior operative elements of FIG. 7;

FIG. 13 shows a sectional view of the cam member which operates by bypass poppet of the second stage regulator; and, FIG. 14 shows a sectional view through circle 14 of FIG. 3.

DESCRIPTION OF THE PREFERRED EMBODIMENTS

Figures 1, 10:
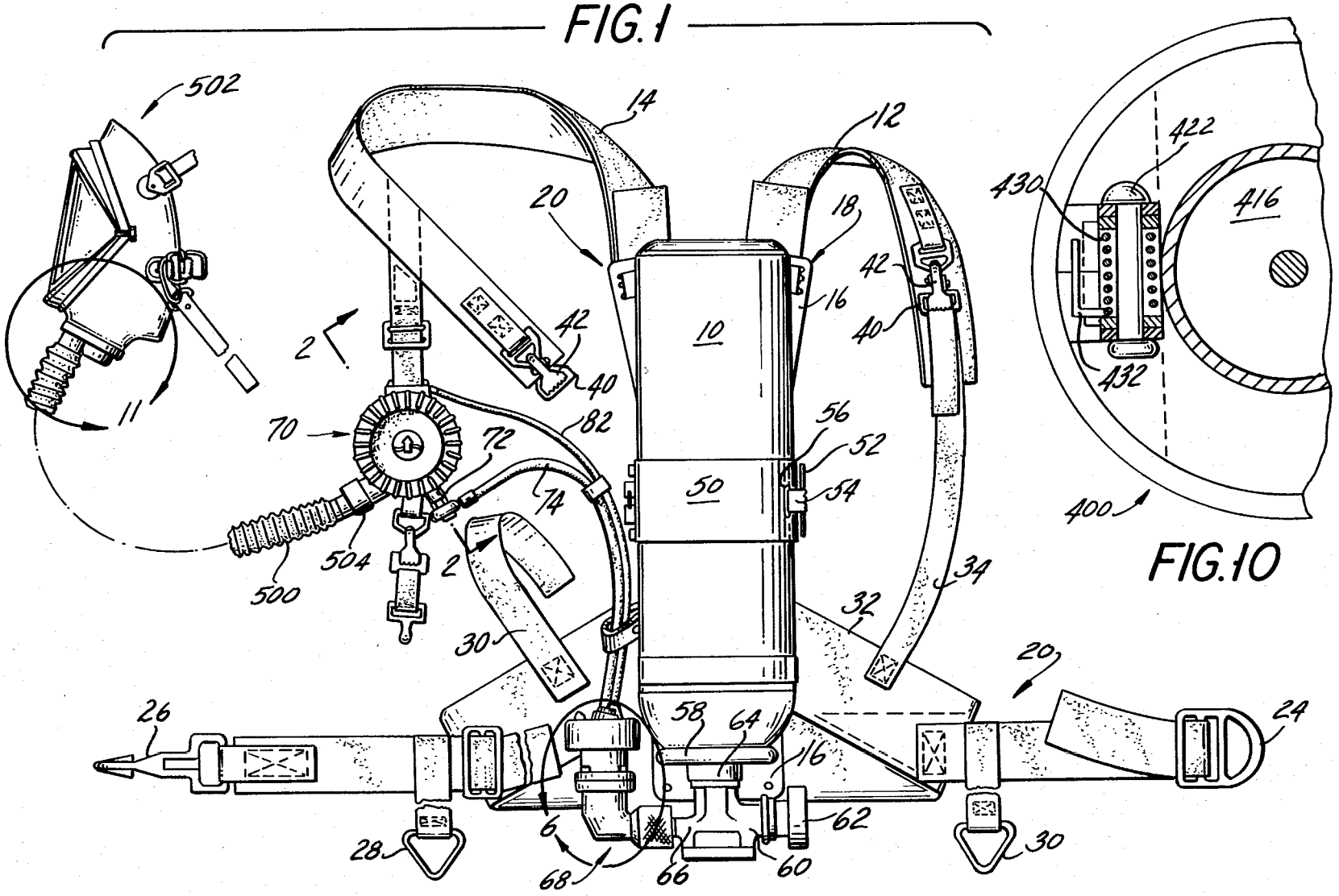
FIG. 1 shows the first and second stage regulator of this invention connected into a system incorporating a tank of breathing gas, harnesses for a backpack holding the tank and a mask to be used in conjunction therewith.
FIG. 10 shows a detailed view looking in the direction of lines 10—10 of FIG. 4 exposing the coil spring and means for securing the closure of the outlet of the second stage regulator.

Looking more particularly at FIG. 1, it can be seen that a tank 10 of pressurized gas is shown. The tank 10 of pressurized gas is held by a pair of shoulder harnesses 12 and 14 that are attached to a backpack 16 that is partially shown. The harnesses numbered 12 and 14 are looped through openings 18 and 20 of the backpack. They are looped doubly backwardly and forwardly through the openings and then terminate as shown overlying the main harness portions 12 and 14.

Each respective harness is attached to a waist strap 20 having a buckle portion 24 that receives a hook clip 26. The buckle portion 24 is looped with a portion of the strap for adjustability. The hook clip 26 is used for attachment to the eye of the buckle 24.

Depending accessory loops 28 and 30 are shown which depend from the main waist harness 20.

The harness member 14 attaches to a strap portion 30 that is connected to a backpack support band 32. The band 32 receives both the harness portion 30 and a second harness portion 34 which attaches to the main harness member 12.

The foregoing backpack assembly and harness allows for carrying of the tank 10 and regulator system of this invention for use by a fireman or industrial user. The two respective straps 30 and 34 attach to the main harness portions 12 and 14 by means of looping through a loop 40. The loop 40 has an overlying spring loaded serrated catch 42 for holding the harnesses 30 and 34 to the upper main harness members 12 and 14.

The tank 10 is held by means of an adjustable metal band 50 having a cam locking handle 52. A tab 54 engages an opening 56 for holding the band 50 in tightened juxtaposition surrounding the tank 10 by the cam lock cinching the band.

The tank 10 at the bottom fits into a U-shaped support member 58 that is attached to the backpack 16 for seating the neck of the tank 10 therein and holding it on the backpack.

The foregoing generally comprises the backpack and the support members for holding and carrying the regulator system described herein. Looking more particularly at the operative elements of the regulator system, it can be seen that a valve 60 is shown with a valve handle 62 connected thereto. The valve handle 62 allows the valving of the gas fron the tank 10. The valve 60 is threaded into the neck 64 of the tank and has an outlet 66 connected to a first or high pressure stage regulator 68 of this invention. The first stage regulator 68 has been shown in greater detail in the remaining figures, particularly FIGS. 6 and 7.

Figure 2:
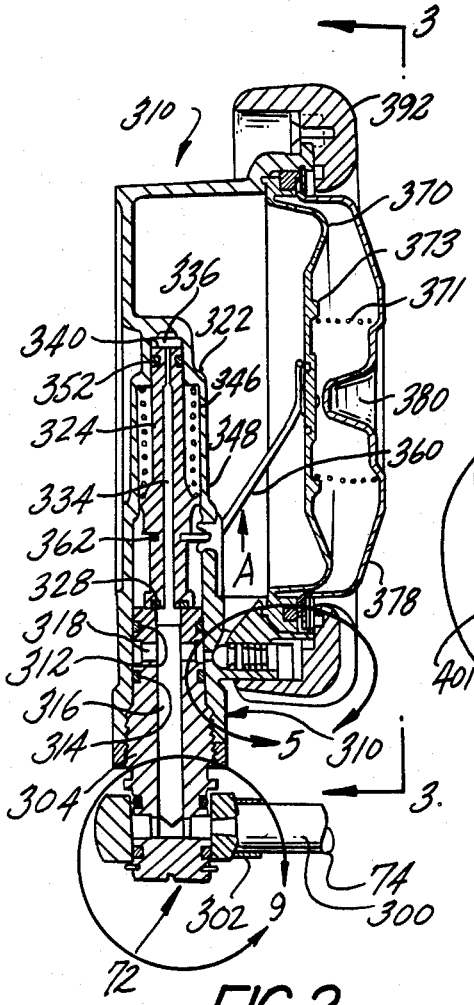
FIG. 2 shows a view of the second stage regulator as sectioned along lines 2—2 of FIG. 1.
Figure 3:
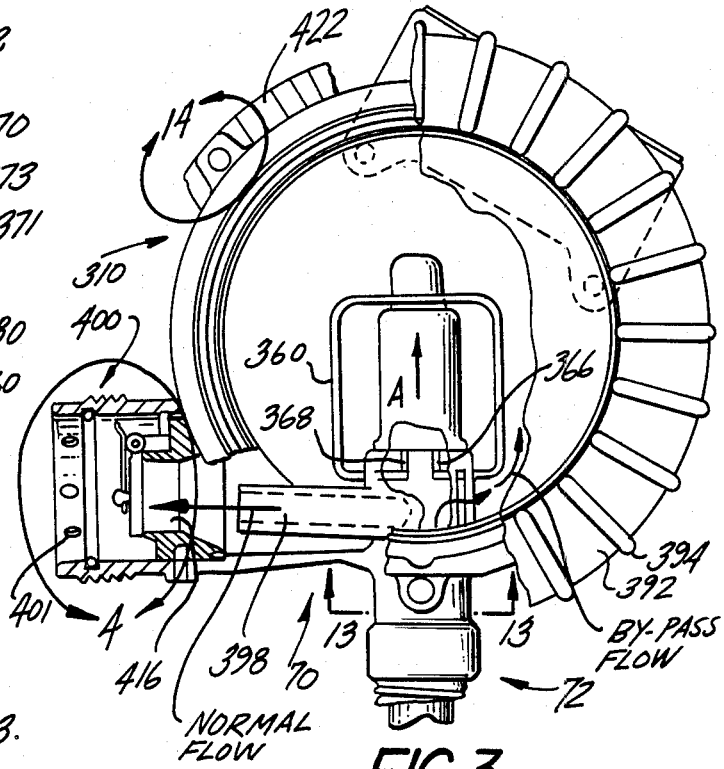
FIG. 3 shows a view looking downwardly through the second stage regulator showing a fragmented and interior portion of the second stage regulator as partially sectioned.
Figure 5:
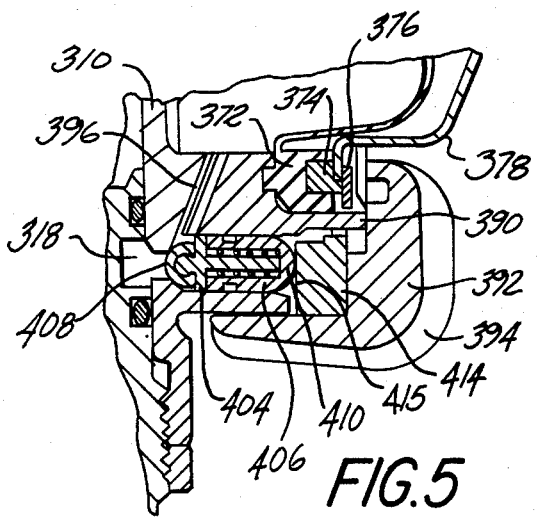
FIG. 5 shows a detail of the bypass poppet assembly of the second stage regulator in a fragmented and sectioned form as encircled by circle 5 of FIG. 2.
Figure 4:
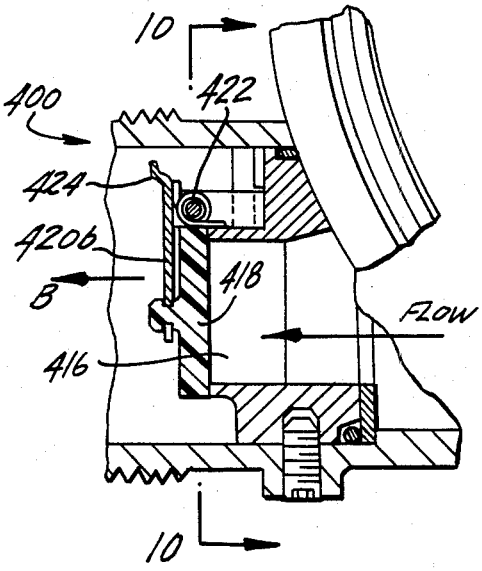
FIG. 4. shows a fragmented sectional view as taken from circle 4 of FIG. 3, which shows a detail of the outlet closure.

The first stage regulator 68 is connected to a second stage regulator 70 which is shown in greater detail in FIGS. 2 and 3. The second stage regulator 70 is connected at its inlet 72 by means of a hose 74 connected to an outlet 76 seen in FIG. 7 of the first stage regulator 68. The hose 74 is preferably connected in the manner as shown in the figures hereinafter between the first stage regulator 68 and the second stage regulator 70. For purposes of convention, the first stage regulator is also referred to sometimes as a high pressure regulator for regulating gas down to an intermediate pressure. The second stage regulator 70 is sometimes referred to as a demand type or low pressure regulator for purposes of providing gas when a user wishes to inhale.

A first stage high pressure port 80 is shown in FIG. 7. The high pressure outlet port 80 can be for determining the pressure of the gas within the tank 10 or other requirements for providing a source of high pressure gas. In particular, this invention shows a hose 82 connected to the high pressure port 80 which is hidden in FIG. 1, but can be seen in FIG. 7. The hose 82 is connected to a pressure gauge which can be of various configurations. The gauge can be a normal Bourdon tube type of pressure gauge or an electronic gauge. Such an electronic pressure gauge can be a fiberoptic gauge which has a means for transducing the high pressure at the high pressure port 80 into light and having a fiberoptic readout at the terminal end. In such a case, the hose 82 would be substituted by the fiberoptic bundles which terminate in a light readout.

Looking more particularly at FIGS. 6 and 7 and the figures that are ancillary thereto, it can be seen that the first stage regulator 68 is shown having a connection means 86 in the form of a hand wheel 88 that has internal threads 90. These threads match a fitting to which it is to be threaded onto, namely the valve 60. The threads 90 when seated on the male member of the valve 60 allow an O Ring 92 to seal the coupling 86 thereto.

In order to provide for a bearing surface, a bearing ring 94 is provided on a nipple 96 with a retaining ring 98 for holding the hand wheel 88 thereon so that it can rotate and be secured on the nipple 96. Nipple 96 is secured by means of being threaded into the first stage entry port or inlet 100 which has threads which receive the nipple 96.

A retainer ring 102 as seen in FIG. 8 is shown for purposes of retaining a screen or filter 104. The screen or filter 104 is a fine mesh screen for screening out any impurities that might pass through an opening 106 of the inlet 100. Thus, gas from the tank 10 that is not completely devoid of particulate material is screened out by screen 104 which is held in place by the retainer 102 being seated thereagainst by means of the nipple 96 being threaded thereagainst.

Looking more particularly at FIG. 7, it can be seen that the inlet port 106 terminates in a high pressure entry port 110. High pressure entry port 110 has a passage connected thereto, namely passage 112 and passage 114. Passage 114 is connected to the high pressure sensing port 80 that is shown in a manner whereby it can receive a device or hose for high pressure connection and sensing of high pressure within the entry port 110.

Passage 112 is specifically designed to pass into chamber 116 for providing regulated gas to a user. Chamber 116 is the main chamber and communicates within a main body or housing 118 of the first stage regulator. The housing or body 118 can be formed from two different castings or pieces and joined along a midline 119.

A plug 120 is shown threaded into an opening and sealed by an O-Ring. Plug 120 is merely for providing a drilling port during manufacture, so that a passage of gas can take place through a port 122 from the chamber 116.

Chamber 116 is valved by means of a main valve assembly or main piston 124 comprising a lower portion 126 or seat assembly, and an upper portion 128, or movable inner valve housing. This is seen in greater detail in FIG. 12. The two respective portions 126 and 128 are joined together in a manner to provide the redundant function and elements hereinafter described.

The seat assembly 126 has an elastomeric or plastic valve cover 130 which is shown in FIG. 12 that allows for a valving of the gas from port 112. The seat assembly 126 is sealed within the chamber 116 by means of an O-Ring 134. The O-Ring 134 seals the seat assembly against the side walls of the main body housing 118 in a cylindrical surrounding portion 136 that allows the seat assembly 126 to move upwardly and downwardly therein.

Gas is allowed to pass into a passage around the seat assembly, and into passage 138 that passes into a bifurcated passage 140 in the upper portion of the seat assembly 126. This bifurcated passage then passes in surrounding relationship through a surrounding chamber 142 upwardly through a radially spaced spacer member 144 or retainer. The retainer 144 has lateral openings which are not shown which allow for the passage of gas from space 142 into a second valving chamber 146. In effect, the gas can pass laterally through the retainer 144 while at the same time maintaining sealing action of the valve.

A seat 148 is shown underlying the spacer 144 which is held in situ therewith. The seat 148 is sealed by means of an O-Ring 150 so that gas will not pass therethrough and escape into the chamber 146 in an unwarranted manner during operation.

An interior piston or second piston 156 is shown sealed by an O-Ring 158 into the side wall of the main piston housing 128. The second piston 156 is held in place by means of a ring retainer 162 and serves to retain the piston 156 so that a spring 164 can be used to balance the interior piston 156.

The entire piston assembly 124 comprising the seat assembly 126 and the housing 128 is balanced by means of a spring 170. The spring 170 is seated at its lower portion against an interior circumferential portion of the main body 118 at one end and a shoulder 172 at the other end. Shoulder 172 includes a seal ring 174, an O-Ring 176, and an interior O-Ring 178. The foregoing are seated against an upper shoulder 180 of the upper housing so that as the entire piston assembly 124 comprising lower portion or seat assembly 126 and housing 128 move upwardly and downwardly in connected relationship, a sealed passage of gas can take place through a passage 184 which passes through the inner or second piston 156.

The inner piston 156 with its passage 184 for the passage of gas from chamber 146 is sealed by means of an O-Ring 188. In this manner, the interior piston 156 can move upwardly and downwardly to provide for the passage of gas through its passage 184 upwardly and outwardly through a port 190. The port 190 is shown connected to a chamber 192 overlying the entire piston assembly 124. The passage 190 connecting chamber 192 is shown in dotted configuration passing behind another assembly which shall be detailed hereinafter.

The entire piston assembly 124 moves upwardly and downwardly during normal operation with the lower portion 126 and the upper portion 128 so as to valve a chamfered valve surface 115 by means of the valve cover 130. Gas thereby passes from the chamber 116 upwardly through the passage 138 as bifurcated at bifurcation 140 and outwardly through the passage 184. This is the normal operation of the piston assembly 125.

If a failure should occur in the operation of the entire piston assembly 124 as biased by spring 170, the secondary or interior piston 156 will take over and provide the operative functions of the invention. In effect, when seat 130 fails to seat against the chamfered valve surface 115, the passage of gas through passage 138 is valved by the second piston 156 or interior piston operating by virtue of its valve stem closing against the seat 148.

The foregoing redundant operation occurs by virtue of the fact that the spring 164 then provides the balancing function in assembly 124. Thus, regulated gas and regulation can take place within chamber 146 by virtue of the chamfered sharpened edges seating against the valve seat 148. Accordingly, the secondary function of the entire piston assembly 124 is such that it provides a redundancy in the eventuality of failure. Such failure is caused through the inability of the main piston assembly 124 with its valve cover to regulate gas from passage 112. Thus, both regulator springs 170 and 164 provide the function of redundancy with the main piston assembly 124 and with the backup interior piston assembly or secondary piston 156.

In the eventuality of a failure, a fireman or industrial user in a dangerous condition need not concern himself with having to provide for free flow of gas to provide a source of breathing gas or by other expediencies. In the event of failure of the first piston 126 one need merely rely upon the continuing function of the secondary regulator with the interior piston 156 continuing to operate to regulate gas from chamber 116 into the outlet 76.

A further improvement of this invention comprises the failure or pressure warning alarm system hereof. The alarm system is one wherein a bell or cup 200 is supported by means of bolts 202 on the upper portion of the housing or casing 118. The bell 200 is struck by means of a rapper 204 that is shown extended from a hex nut 206 threaded into the main body 118.

The rapper 204 strikes the bell 200 to provide an alarm when a pre-established pressure or failure has been sensed. The rapper or striker 204 is biased by means of a spring 210 that is shown against the hex nut 206 and a base portion 212 of the rapper.

When a pre-established pressure is sensed in line 114, which corresponds to the pressure in chamber 220, a poppet assembly 222 is driven downwardly by means of a spring 224. In effect, the poppet assembly 222 is constantly biased by spring 224. However, when pressure in the chamber 220 which is in effect the high pressure in line 114 is sensed below a certain level, the poppet assembly 222 will unseat from an adjustable elongated valve seating member 228 having seat 229. This allows for the passage of gas through an opening 230 in the elongated valve seat member 228. The elongated valve seat member is threaded into the main body 118 by means of threads 234 and can be adjusted upwardly and downwardly by means of a notch 236 into which a screw driver can be fit for threadedly adjusting the valve seat 228 upwardly and downwardly.

Valve seat member 228 is sealed by means of two O-Rings seated within a band assembly 240. Thus, passage of gas is restricted from going around the elongated seat 228 and passes through the opening 230.

The poppet assembly 220 can be adjusted by means of a poppet adjusting plug 244 which is threaded into the housing and sealed by an O-Ring. This provides the chamber into which the poppet assembly 222 moves upwardly and downwardly and has a continuation of the high pressure port 114 passing therethrough.

When low pressure is sensed in the high pressure line 110, the spring 224 drives the poppet 222 downwardly. This allows the passage of gas through the passage 122 upwardly through the opening 230, through a restricter 250 that is threaded downwardly into an opening.

Restrictor assembly 250 is sealed by means of an O-Ring 252 and provides for a passage 254 into a chamber 256. Chamber 256 is in turn such that it terminates in a valve surface 260. Valve surface 260 is valved by the rapper assembly 212 and an elastomeric or resilient valve seat 264 normally overlies the valve seat 260 until gas passes into chamber 256.

The restrictor assembly 250 comprises a sliding poppet 251 biased by spring 253 into the downward seated position as shown. When high pressure gas passes through passage 230, it drives the poppet 251 upwardly to allow restricted high pressure gas to pass into chamber 256 to operate the rapper 204. This can occur upon failure of the piston 126 to seat against surface 115.

If the restrictor were not placed in the line, the high pressure gas upon failure would be so great as to cause the rapper to remain in an extended position and not reseat on seat 260. Of course, when rapping or warning is required due to pre-established low pressure in tank 10, there is no need to restrict the pressure and the rapper 204 works normally.

Upon gas passing into chamber 256 it causes the unseating of the rapper or knocker 204 so that it rings against the side of the bell 200. This is done intermittently by the spring 210 causing it to close back and cover the valve seat 260. Gas upon being emitted from the chamber 256 after the valve cover 264 unseats the rapper 204 passes through an opening 274 and outwardly into the atmosphere.

As can be appreciated, various alternative embodiments can be utilized with this particular application. Nevertheless, it should be understood that the configuration hereof is such wherein it provides a unique first and second redundant piston in the entire piston assembly and an improved adjustable ringer. The sensitivity of the ringer can be adjusted by means of moving the poppet adjuster 244. The entire elongated valve seat member 228 can be moved upwardly and downwardly to compensate for different spring pressures provided by spring 224 against the poppet 222. The restrictor assembly 250 provides a warning upon failure of piston 226 and the depletion of high pressure gas as described hereinbefore.

Looking more particularly at the second stage or demand regulator, it can be seen wherein it has been connected at its inlet 72 from the outlet 76 of the first stage regulator.

The inlet fitting is shown in greater detail in FIG. 9 wherein the hose 74 is shown connected to the inlet fitting comprising a hose fitting having serrated or barbed tangs 300 that engage the hose 74 and further comprise a ferrule 302 to secure the hose therein. The hose is connected to the fitting 72 which has threads 304 that engage the second stage regulator.

The inlet 72 is sealed within the housing 310 that has been shown generally as a housing member comprising a main body or housing for the entire second stage regulator. The second stage fitting 72 is sealed in the housing 310 by means of two O-Rings 312 and 314. It furthermore has a passage 316 passing therethrough which has a tee 318 thereacross. The tee 318 has a function that will be explained hereinafter with regard to an ability to allow the free flow of air therethrough upon regulator failure.

The second stage regulator housing 310 has an interior valve housing 322. The valve housing 322 receives a piston member 324. The piston member 324 is a valving member that provides a valve cover by means of a resilient valve cover member 328 overlying a chamfered surface 330 seen as the chamfered surface of the inlet fitting 72 of FIG. 9. This chamfered surface 330 allows for the valve cover 328 to be sealed thereover.

The piston 324 has a passage 334 passing therethrough which terminates in a cavity or chamber 336 within the piston housing 322.

The pressure in the chamber 336 that passes through the passage 334 tends to balance the valve and piston by the exposure against an area equal to surface 340. This area 340 is equivalent to the surface that is exposed on the valve cover 328 which is exposed to pressure in passage 316. Thus, the valve piston member 324 is in a roughly balanced configuration as to those pressure forces on either side of it. This provides for balanced operation to prevent high cracking forces being necessary to open the valve wherein the valve cover 328 lifts and exposes the passage 316 for the passage of gas therethrough.

The piston 324 is biased by means of a spring 346 that is seated on a shoulder of the piston housing 322 at one end, and on a plurality of radial extensions 348 on the piston 324. The radial extensions 348 can be in a cruciform so as to allow the passage of gas therethrough or can be a circumferential flange. One way or the other, a sealant must be provided to prevent gas from leaking into the chamber 336 and as a consequence, an O-Ring 352 is provided for this function. Thus, the intermediate pressure in passage 316 before it is valved is equivalent to the pressure in chamber 336.

The piston 324 which unseats the cover 328 from over the circumferential edge 330 that has been chamfered is operated by a poppet valve lever 360. The poppet valve lever 360 is pivoted on a pivot point 362 and is mounted in the side of the housing or valve housing 322 to provide the pivotal action. As the poppet valve lever 360 is pivoted downwardly, it causes upstanding arms 366 and 368 to articulate in the direction of arrow A. This causes the piston 324 to move in the direction of arrow A thereby unseating the valve cover 328 from the valve surface 330.

Movement of the poppet valve lever 360 is accomplished by means of a diaphragm 370. The diaphragm 370 is such that it has a major flange 372 which receives a circumferential ring 374 therein. The circumferential ring 372 is held in place by a snap ring 376 that also holds a cover 378 on to the overall housing 310. The cover 378 can be of any suitable configuration but is shown having the configuration generally shown in FIG. 2 with a depression 380.

The snap ring 376 engages the flange 372 and circumferential ring 374 and the edge of the top 378 into tightened engagement with the housing 310.

The housing 310 terminates in an upstanding surface 390 on which a hand wheel 392 turns. The hand wheel 392 has upstanding gripping surfaces or rings 394 which allow one to hold onto the hand wheel 392 to rotate it.

The hand wheel 392 allows for the free flow of gas through passage 318, then through a passage 396 into the cavity of the regulator housing 310. From thence, it can flow out under diaphragm 370, to passage 416 to an outlet 400 which is in turn connected to a hose in the manner detailed hereinafter.

The outlet has radial openings 401 that allow flow therethrough. This is to protect the regulator from back pressure when one places a hand over the outlet during flow therefrom. In other words, when flow such as during a free flow condition is taking place, and one places an object or hand over the outlet, it will not cause back pressure to damage the regulator elements, such as the diaphragm.

The connection of the passage 396 to the passage 416 is effectuated by movement of a spring biased poppet 404. The spring biased poppet 404 is biased by spring 406. This forces a sealing member 408 connected to the spring poppet 404 into the passageway 318 thereby precluding passage of gas through the passage 396.

In order to relieve the pressure from the poppet 404 so that the spring 406 is less compressed and allow the sealant 408 to lift, a cam ring 414 on the inner surface of hand wheel 392 is utilized. The cam ring 414 is shown in FIG. 13, wherein it has a sloping surface 415 which rides against the top of a bullet-shaped poppet 410 to cause it to move upwardly and downwardly against the spring pressure.

In order to provide positioning of the hand wheel 392, the bottom surface of the cam ring 414 has a number of serrations 422 in which two bullet-shaped detents 420 which are spring loaded by springs **420*a* provide resistance to the hand wheel when turned. Thus, as the hand wheel is turned, it engages the serrations one by one, thereby providing positioning. The hand wheel can also have a spring loading means for engaging the serrations or matched serrations so as to provide engagement between the serrations 422** and those underlying the hand wheel.

When the hand wheel is turned in a counter clockwise direction as shown in FIG. 3, the cam surface 415 serves to relieve the pressure on the top of the poppet assembly 404. This allows the closure or sealant 408 to unseat itself from the covering relationship over passage 318 so that free flow can pass through passage 396.

As an aside, the flow from the poppet valve piston 324 flows out of passage 398 which has been shown in lateral relationship and is not seen except in FIG. 3.

Thus, regulated flow by the piston 324 flows only through passage 398.

Passage 398 is connected to the outlet 400 by means of a passage 416 that is covered by a cover 418 having an elastomeric portion. The elastomeric cover 418 is connected to a tilting lever 420*b*. The tilting lever 420*b* has a pivot point 422 to which it is connected. The tilting lever 420*b* also has an engaging lever extension 424 for purposes of receiving a hose thereagainst. The hose drives the tilting lever 420*b* in the direction of arrow B so as to remove the cover 418 from the edges of passage 416. A more detailed showing of the pivoting assembly around point 422 can be seen in FIG. 10 wherein a coil spring 430 engages the lever 420*b*, and has an upstanding portion 432.

In order to lift the cover 418, the lever arm 424 is engaged by a hose connection that is received within the outlet 400. The hose pushes backwardly against the lever arm 424 thereby pushing the tilting lever 420*b* in the direction of arrow B. This in turn opens up passage 416 so as to provide passage of gas outwardly into a hose 500 that is seen connected to a mask 502 that has been further detailed in FIG. 11.

The mask 502 can be substituted by any other suitable oral nasal or oral connection means for the breathing of the gas supplied by the regulator system of this invention.

When the hose 500 with a hose fitting 504 is threaded onto the threads of the outlet 400 the hose fitting engages the lever arm 424. This causes the lever 420*b* to tilt backwardly in the direction of arrow B thereby exposing passage 416 for the passage of gas therethrough. Thus, debris and other extraneous materials are prevented from entering the sensitive parts of the regulator by the cover 418. This is accomplished until air is required by engagement of a hose into outlet 400.

The passage of gas is normally undertaken by means of regulation provided by piston 324. This is accomplished by piston 324 moving so as to lift the cover 328 from off of the valve surface 330 provided on the inlet fitting 72. When the piston member 324 lifts backwardly, the flow of gas therethrough is into passage 398. This flow of gas is caused by the lever or poppet valve lever 360 being deflected by means of the diaphragm 370 moving into the cavity of the housing 310. This movement into the housing 310 is effectuated upon a person breathing inwardly thereby creating the inbalance of pressure in the hose 500.

In order to provide for proper biasing and sensitivity of the diaphragm 370 against the tilt valve lever 360 a spring 371 is provided. The spring 371 maintains the diaphragm 370 in its engaged relationship with the poppet valve lever 360 by being implaced within a circumferential flange 373 of the diaphragm 370.

When free flow is desired, the hand wheel 392 is turned in a counter clockwise direction against the serrations 422 that can be engaged by either a spring detent underlying the hand wheel 392 or by having matched serrations against which it moves. At this time the cam member 414 on the underside of the hand wheel 392 moves in a counter clockwise direction thereby exposing the lesser dimension of cam surface 415 against the top of the poppet assembly 404. This causes the poppet assembly to back off from the tightly engaged relationship of the spring member 410 which holds the surface 408 in engagement with passage 318. Thereafter, free flow can then take place through passage 396 and the hose 500.

Looking at the mask of FIG. 11 in greater detail, it can be seen that a mask has been provided with a skirt 520 that receives two strap members 522 and 524. The straps engage the opposite side of the mask in symmetrical relationship. The skirt 520 has an inner sealing edge 530 into which a person's face is exposed.

The mask 502 and skirt 520 have a rim 534 in the form of a band which is clamped by means of a nut 536 for holding a lens 538 therein. The lens 538 has a bead 540 surrounding the lens 538 so as to protect it from abuse against surfaces to which the lens 538 is exposed.

The lens 538 is sealed within the skirt 520 within a groove 544 into which a flange 546 of the lens 538 extends. In this manner, the clamping band 534 can engage the entire lens 538 so as to hold it within the skirt 520 or groove 544.

In order to provide for the introduction of gas from the hose 500, the hose is clamped to a mask frame portion 560. The mask frame portion has an outlet one way valve 562 which is in the form of a flapper overlying a cruciform cross member 564 having openings therethrough so that internal pressure caused by exhalation into the cavity can deflect the flapper 562 to allow for exhaust. However, the flapper upon inhalation is sealed against the cruciform legs and surrounding portion of the web 564 to prevent inhalation through the outlet.

A sealed diaphragm 570 is sealed by means of a ring 572 that is threaded into the housing 560. This diaphragm 570 allows for the emanation of vibratory noise or speaking sounds in the direction of arrow C out of the housing 560. The ring 572 clamps the diaphragm and seals it by means of an O-Ring 580 to prevent the passage of gas therethrough as opposed to the opening 561 sealed by the valve member 562.

As can be seen from the foregoing disclosure, this invention is a step forward over the state of the art with regard to the entire system and the regulator functions inherent within each of the systems. Accordingly, this invention should be read broadly in light of the following claims hereinafter.

We claim:

1. A breathing gas regulator comprising:

a housing having an inlet adapted to be connected to a source of pressure, and an outlet;

a first piston having first and second ends and slidably mounted in said housing, a chamber in said first piston between said ends, a first passage extending at least partially through said first piston from said first end thereof to said chamber;

first valve means operatively connected to said first end of said first piston for controlling gas through said inlet from said source of pressure, through said first passage, and into said chamber;

a second piston having first and second ends and slidably mounted in said first piston, a second passage means extending through said second piston from said first end to said second end, second valve means operatively connected to said first end of said second piston for controlling gas from said chamber through said second passage means;

said second ends of said first and second pistons having surfaces fluidically communicating with said outlet thereby being subjected to outlet pressure;

first spring biasing means for biasing said first piston away from said inlet to regulate gas flow by said first valving means from said source of pressure through said inlet and then to said outlet; and, second spring biasing means for biasing said second piston within said first piston away from said chamber to maintain said second valve means open until said first piston fails to regulate gas from said source of pressure whereupon said second piston is operated to regulate gas from said source of pressure.

2. The regulator as claimed in claim 1 further comprising:

means for monitoring when pressure declines below a certain pre-established pressure within said source.

3. The regulator as claimed in claim 2 further comprising:

a monitoring means formed as a bell with a ringer which rings when a pre-established pressure has been reached within the source of high pressure gas.

4. The regulator as claimed in claim 3 wherein said alarm comprises:

a poppet assembly in spring biased relationship to the higher pressure;

a valve seat which can be covered by said poppet;

a passage from said valve seat to a ringer with a piston having a valve cover seated over said passage; and, spring biasing means for holding said ringer piston in overlying relationship to said passage until sufficient pressure buildup has been created by the opening of said poppet to unseat said ringer and cause it to strike a bell.

5. The regulator as claimed in claim 1 in combination with a second intermediate stage demand regulator.

6. The combination as claimed in claim 5 wherein:

said second stage regulator is connected to an outlet of said first stage regulator; and, said second stage regulator has an internal piston for regulating the pressure regulated by said first stage regulator, wherein said piston is balanced against the valve surface thereof by a passage passing through said piston terminating in a chamber which allows balancing pressure to act against said piston.

7. The combination first and second stage regulator as claimed in claim 6 further comprising:

said second stage regulator having means for providing free flow from said first stage regulator through said second stage regulator.

8. The combination as claimed in claim 7 wherein:

said second stage regulator incorporates a diaphragm connected to said second stage piston by means of a valve lever which is pivotally oriented for actuation of said piston when said diaphragm collapses to move said piston in a manner for unseating it from its seat.

9. The combination regulator as claimed in claim 7 further comprising:

means for providing free flow in the form of a poppet valving member operably connected to a hand wheel having mechanical resistance supplied thereto in the direction in which it is moved for free flow.

10. The combination as claimed in claim 9 wherein:

said poppet means is angularly oriented to said hand wheel and wherein said hand wheel comprises a cam surface for overlying cammed movement against said poppet so that when said greater cam surface is against said poppet, said poppet is closed to prevent free flow and when said lesser cam surface is oriented over said poppet said poppet can open to allow for free flow.

11. The combination as claimed in claim 10 further comprising:

a cover over the outlet of said second stage regulator which can be opened when a connection is inserted thereagainst.

12. The combination as claimed in claim 11 wherein:

the outlet of said second stage regulator is adapted for connection to a hose for attachment to a mask; and, said cover comprises a tiltable lever having a covering member for covering said outlet of said second stage regulator in a manner whereby said lever is tilted by said hose connection to provide for passage from said second stage regulator.

13. A first stage regulator for regulating a source of pressurized gas wherein the improvement comprises:

a housing having an inlet adapted to be connected to a source of pressurized gas, and an outlet;

a first piston having first and second ends slidably mounted in said housing, a chamber in said first piston between said ends, a first passage at least partially extending through said first piston in connected relationship to said first end and to said chamber;

first valve means operatively connected to said first end of said first piston for controlling gas through said inlet from said source of pressurized gas for passage into said chamber through said first passage;

a second piston having first and second ends wherein said piston is slidably mounted in said first piston;

second passage means extending from said first end to said second end of said second piston;

second valve means operatively connected to said first end of said second piston for controlling gas through said second passage means of said second piston from said chamber;

said second ends of said first and second pistons having surfaces fluidically communicating with said outlet thereby being subject to outlet pressure;

first spring biasing means for biasing said first piston away from said inlet to regulate gas flow by said first valving means from said source of pressure through said inlet and then to said outlet; and, second spring biasing means for biasing said second piston within said first piston to maintain said second valve means open until said first piston away from said chamber fails to regulate gas from said source of pressure whereupon said second piston is operated to regulate gas from said source of pressure.

14. The regulator as claimed in claim 13 further comprising:

a valve seat formed as a chamfered surface in adjacent relationship to said inlet.

15. The regulator as claimed in claim 13 further comprising:

an alarm system for providing an alarm when pressure has decreased from said pressurized source below a pre-established level.

16. The regulator as claimed in claim 15 wherein:

said alarm comprises a poppet having a surface exposed to said high pressure from the high pressure gas to be regulated;

a valve seat for covering by said poppet;

a ringer formed as a piston in connected relationship to said valve surface so that when said poppet lifts off said valve surface said piston forming said ringer will cause a ringing and audio alarm indicating a preestablished pressure within said high pressure gas.

17. The regulator as claimed in claim 16 further comprising:

means for adjusting said poppet with regard to the amount of pressure required to unseat said poppet.

18. The regulator as claimed in claim 17 further comprising:

a ringer formed as a piston having a resilient surface for overlying a passage in connected relationship to said valve seat to be covered by said poppet;

spring biasing means for biasing said piston ringer in the closed direction; and, a resonant material in adjacent relationship for resonating when said ringer strikes said resonant material.

19. The regulator as claimed in claim 18 further comprising:

means for changing the rate at which said ringer rings against said resonant material.

20. The regulator as claimed in claim 19 in combination with a second stage regulator having a tilt valve assembly that is balanced on the valving surface thereof by means of a passage passing through said piston and terminating in a chamber which receives gas that has been regulated from said first stage regulator against a surface equivalent to the surface of said valve cover in exposed relationship to said regulated pressure.

21. The combination as claimed in claim 20 further comprising:

means for bypassing said piston of said second stage regulator.

22. The second stage regulator as claimed in claim 21 further comprising:

a poppet which is caused to move freely by a cam surface for providing free flow through said second stage regulator bypassing said regulating function provided by said piston.

23. The combination as claimed in claim 22 further comprising:

a mask adapted for connected relationship to said first and second stage regulators for the flow of gas thereinto having a diaphragm for providing audio speech into said mask from the interior of said mask to the exterior.

24. A second stage regulator adapted for connected relationship to a first stage regulator wherein the improvement comprises:

a housing having an interior chamber and an outlet therefrom;

an inlet connected to said interior chamber having a first passage terminating in a valve seat and adapted for connected relationship to a high pressure regulator;

a piston housing having a chamber and mounted within said regulator housing;

a piston slidably mounted within said chamber of said piston housing having a valve cover on one end thereof for overlying relationship with said valve seat and a second passage through said piston providing a fluidic path from said valve cover to said chamber within said piston housing for exposure of gas to the opposite end of said piston;

the surface of the opposite end of said piston within said chamber being of a size equivalent to the size of the valve cover of said piston covering said first passage;

a diaphragm mounted on said housing and partially defining said interior chamber with said housing, a lever pivotally mounted in said interior chamber and oriented for operating said piston upon deflection of said diaphragm;

a third passage connected between said first passage and said third;

a poppet means for closing said second passage; and, means for moving said poppet from closing said second passage to provide for the diversion of gas therethrough for free unregulated flow through said second stage regulator comprising a camming member movably mounted on said regulator housing which cams said poppet member into a respective closed or opened position.

25. The regulator as claimed in claim 24 wherein said camming member is affixed to a movable hand wheel mounted in surrounding relationship to the regulator housing.

26. The regulator as claimed in claim 25 wherein:

said hand wheel is provided with a means for restricting the movement thereof.

27. The regulator as claimed in claim 24 comprising:

a cover pivotally mounted over said outlet which can be displaced upon the movement of a hose connection thereagainst.

28. The regulator as claimed in claim 27 wherein:

said means for displacing said cover comprises a lever connected to said cover with a lever arm against which said hose connection is advanced in order to rotate said cover into an open position thereby opening said housing.

29. The regulator as claimed in claim 28 further comprising:

said outlet further including a tubular member mounted to said regulator housng and surrounding said cover and having openings therethrough to provide for the passage of gas from said outlet through said openings when a second cover is implaced over the tubular member from the first cover.

* * * * *